US006310332B1

(12) United States Patent
Gerrard

(10) Patent No.: US 6,310,332 B1
(45) Date of Patent: Oct. 30, 2001

(54) HEATING BLANKETS AND THE LIKE

(75) Inventor: Grahame Gerrard, Aston (GB)

(73) Assignee: Winterwarm Limited, Birmingham (GB)

( * ) Notice: Subject to any disclaimer, the term of this patent is extended or adjusted under 35 U.S.C. 154(b) by 0 days.

(21) Appl. No.: 09/581,025

(22) PCT Filed: Dec. 2, 1998

(86) PCT No.: PCT/GB98/03597

§ 371 Date: Aug. 3, 2000

§ 102(e) Date: Aug. 3, 2000

(87) PCT Pub. No.: WO99/30535

PCT Pub. Date: Jun. 17, 1999

(30) Foreign Application Priority Data

Dec. 5, 1997 (GB) ..... 9725836

(51) Int. Cl.[7] ..... H05B 1/02

(52) U.S. Cl. ..... 219/505; 219/212; 219/497; 219/481; 338/22 R

(58) Field of Search ..... 219/481, 212, 219/497, 504, 505, 549, 508; 307/117; 338/22 R, 225 C

(56) References Cited

U.S. PATENT DOCUMENTS

| | | | |
|---|---|---|---|
| 3,375,477 | 3/1968 | Kawazoe . | |
| 3,493,727 | 2/1970 | Hosokawa et al. . | |
| 4,309,597 * | 1/1982 | Crowley | 219/549 |
| 4,607,154 * | 8/1986 | Mills | 219/212 |

FOREIGN PATENT DOCUMENTS

| | | |
|---|---|---|
| 0 244 047 A2 | 6/1987 | (EP) . |
| 1.193.593 | 11/1959 | (FR) . |
| 2 590 433 A1 | 5/1987 | (FR) . |
| 746017 | 3/1956 | (GB) . |
| 1 423 076 | 1/1976 | (GB) . |
| 2 148 677 A | 5/1985 | (GB) . |
| 07006867 | 1/1995 | (JP) . |

* cited by examiner

*Primary Examiner*—Mark Paschall
(74) *Attorney, Agent, or Firm*—Woodard, Emhardt, Naughton, Moriarty & McNett

(57) ABSTRACT

An elongated heating element for an electric blanket comprising a first conductor means to provide heat for the blanket and extending lengthwise of the element, a second conductor means extending lengthwise of the element, and a meltdown layer between the first and second conductor means which is selected, designed and constructed or otherwise formed so as to display an NTC, and including electronic controller set to detect a change in the resistance of the meltdown layer to provide a means of changing the power supply to the first conductor means (providing heat to the blanket), to prevent destruction of the melt down layer(.), the element further including a meltdown detection circuit for detecting meltdown of the meltdown layer and for terminating power to the first conductor means in the event that the control means fails and the meltdown layer heats up to a pre-determined degree.

18 Claims, 3 Drawing Sheets

HEATING BLANKETS AND THE LIKE

This invention relates to what are termed herein as "blankets" and in the majority of cases this will be the apt description, but in fact the items may be more generally described as sheet materials as they will not necessarily in all cases be used as "blankets". The sheet materials are however in all cases provided with electric heating elements and as the majority of sheet materials which have heating elements can accurately be described as blankets, only this expression is used hereinafter, in the interests of simplicity of description, but it is to be remembered that the invention can be applied to other sheet heating devices, such as pads, and seat warmers.

In any event the invention is more specifically concerned with heating elements for such blankets.

Conventionally, an electric blanket comprises a heating element in the form of a long tubular assembly comprising an inner core around which is wound a first or inner resistance heating conductor, a plastic (e.g. polythene) meltdown tube which overlies the inner conductor, a second or outer, resistance heating conductor which is wound on the plastic meltdown tube, and an outer cover tube. The meltdown tube therefore forms a meltdown layer between the conductors.

At one end of the assembly the conductors are connected or are for connection to an alternating current power supply, whilst at the other end, the conductors are connected through a one way rectifier, e. g. a diode, so that only half cycles of one type pass through the conductors. It is usual for only the positive half cycles of the power supply to pass through the conductors.

The plastic tube is called a meltdown tube as it forms the means of preventing overheating of the blanket, insofar as if the blanket element overheats, the plastic tube will melt, which has either the effect of causing a short circuit between the conductors if the melting takes place at the first end of the element, or of allowing the negative half cycle current to flow through the conductors, and in either case, the condition can be detected, and the power shut off.

Although there are shortcomings with the conventional blanket, virtually all electric blankets are constructed as described above. One of the shortcomings is that when a meltdown condition is detected, the heating element is irreparable and the blanket is useless. Clearly, this represents a considerable wastage.

Attempts have been made to provide that if an overheat condition takes place, there will be control of the power supply to prevent the blanket from being rendered useless, and in one such attempt, a third electric conductor (for example of the so called "tinsel" type) is used. This third conductor is placed in the inner core, and is separated from the adjacent inner conductor by a layer of specially doped PVC to provide a resistance between the inner conductors and the third conductor. This doped PVC has a negative temperature characteristic (NTC) as between temperature and resistance, or in other words as the temperature of the material increases, so the resistance of the material decreases. The NTC is furthermore of a high value in that the resistance between the inner conductor and the third conductor at room temperature might be in the order of mega ohms and at a temperature of say 70° C. would be in the order of several hundred ohms. In the electric blanket fitted with this third conductor, use is made of the NTC, by electronic means, to detect the change in resistance which takes place when overheating takes place, so that the power to the blanket can be modified before meltdown takes place, and therefore the blanket is not rendered useless when overheating takes place. This arrangement can also be used for temperature control purposes to achieve user select conform levels.

The three conductor system also has disadvantages, including that the addition of the third conductor and the NTC material tends to make the element, and hence the blanket, thicker and less flexible, and of course the blanket tends to be more expensive. As with the two conductor type of blanket, the three conductor type has to function in meltdown mode if the third conductor control system fails.

Even when known NTC layers are used in two conductor heating elements, it is difficult to achieve uniform characteristics along the whole run of the heating element so that calibration control is often required, which is expensive and time consuming.

At the heating devices are usually sold in different sizes, each device has a different length of heating element, so that the NTC values being fed back to the control unit are different for different devices and therefore calibration of each device is again required.

Another approach is the PTC (positive temperature co-efficient) method. This is an American system which uses a carbon impregnated polymer fed by two parallel busbars to form a self regulating element. In theory is a good system, but is has the disadvantages that it is expensive, is difficult to manufacture, is bulky which increases the bulk of the heating appliance, and it is prone to breakdown at European voltages in the order of 240 volts (as opposed to 110 in the USA)

It is also known to include bi-metallic strips to detect high temperature levels, but these add cost and bulk to the device and are invariably difficult to fit.

The present invention is concerned with the provision of an electric blanket which is of the two conductor type (only one of which need by a heating means), as opposed to the three conductor type, but wherein the detection of an overheating condition does not result in the destruction of the heating element and hence the blanket, whereby the blanket can be re-used.

In accordance with the invention there is provided an elongated heating element for an electric blanket comprising a first conductor means to provide heat for the blanket and extending lengthwise of the element, a second conductor means extending lengthwise of the element, and a meltdown layer between the first and second conductor means which is selected, designed constructed or otherwise formed so as to display a NTC, and including electronic control means set to detect a change in the resistance of the meltdown layer to provide a means of changing the power supply to the conductor means providing heat to the blanket to prevent destruction of the meltdown layer.

In a first preferred form, the second conductor means is also a heat providing conductor means, and both conductor means may comprise heating wires.

In an alternative arrangement, the second conductor means may be a detection or sensing conductor which serves to provide a current path in the event that the temperature of the blanket deviates from a pre-set value. Specifically, the sensing conductor may have a positive resistance characteristic (PTC), so that when it heats up its resistance increases and this is used by the electronic control to control the power to the heating conductor means.

The sensing conductor may also provide a current path, which is also through the NTC layer, in the event of that layer showing a condition of too high a temperature, requiring the power to the heating conductor means to be switched off.

Preferably, the meltdown layer has a NTC and a meltdown characteristic low enough (typically 120–130° C.) so as to enable the blanket to pass the relevant safety tests required by current regulations, such as IEC regulations. In this connection, current doped PVC's do not have a low enough melting point, but modified PVC's which are softer are suitable. In one example, a soft PVC, which is doped with 20% by weight of Stantonin Antimony, is suitable.

The meltdown layer may be arranged to have a small NTC and the electronics may be arranged to detect extremely small resistance changes in the meltdown layer, before meltdown actually occurs.

Normally, in the three conductor blankets as described, as the electronics are simple, a large NTC is required to enable the control described to operate satisfactorily, and for plastics materials which could be used as meltdown materials to have a large NTC they have to be doped so heavily that they lose the ability to act as meltdown materials. In consequence, the three conductor construction was conceived.

With the present invention, the meltdown layer, of a low temperature meltdown characteristic, also serves as the NTC layer and therefore no third conductor is required, and in fact a small meltdown layer can be used, leading to the use of thinner, less obtrusive electric components. The invention has particular advantage in the so-called over blankets which are used for outer heating devices for men and animals.

The meltdown capability and the NTC may result from the use or design of a single material, or alternatively, the respective qualities may be obtained by using a meltdown plastic, such as polythene or cross linked polyethylene and coating of mixing it with a dope or the like to achieve the required NTC performance.

Because it is preferred that the NTC should be of a small value, appropriate, high performance electronic should be adopted for detecting the small changes in the meltdown layer before meltdown takes place, thus preventing the element and the blanket from destruction in the event or overheat.

Embodiments of the invention will now be described by way of example, with reference to the accompanying drawings, wherein.

Figure 1:
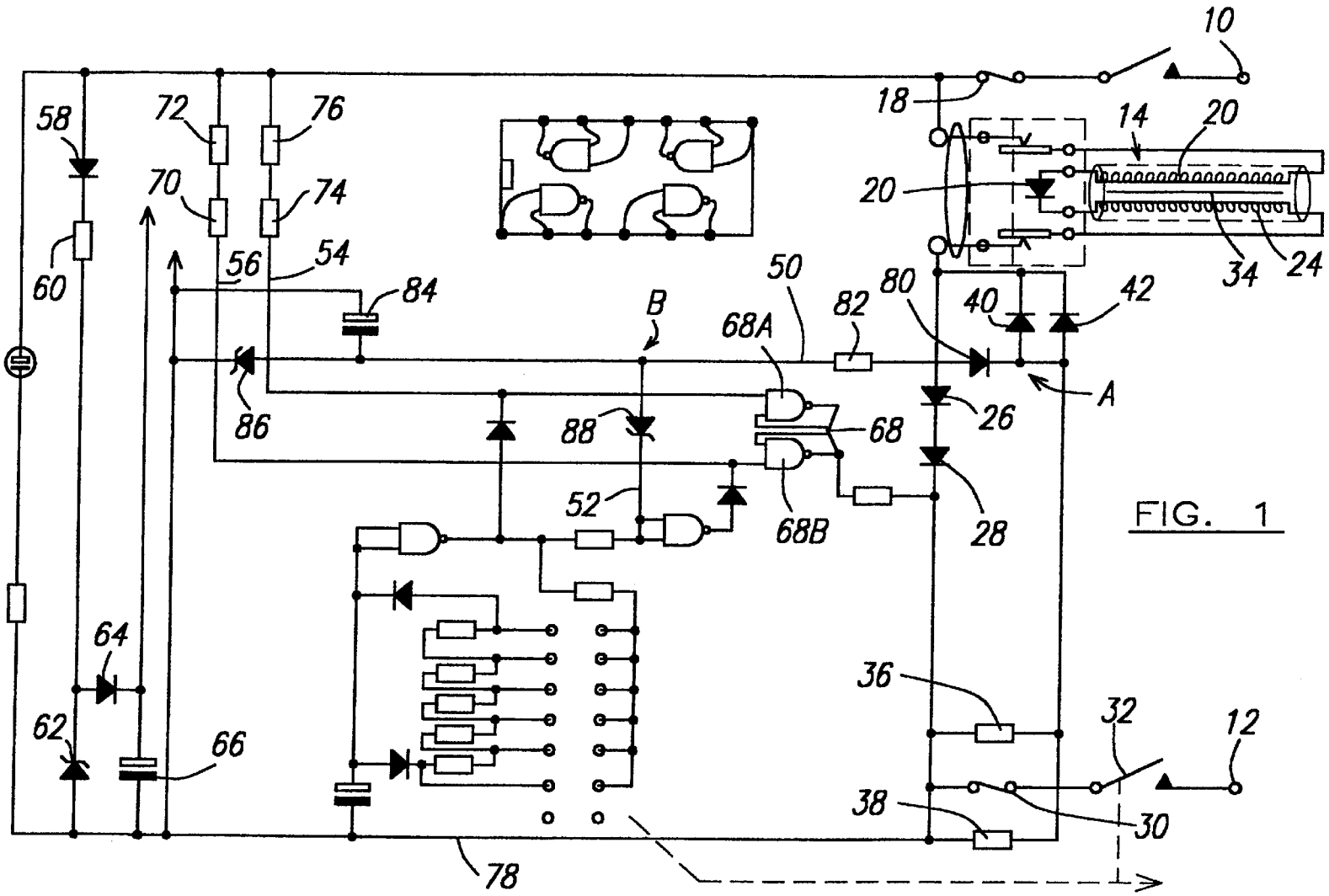
FIG. 1 shows a circuit diagram of a heating element according to a first embodiment of the invention.

Referring to the drawings, the circuit shown comprises input terminals 10, 12 to which is applied alternating mains voltage. The mains voltage is applied after rectification to the heating element 14 of the blanket (not shown). The power is applied through the circuit comprising switch 16, fuse 18, the inner conductor 20, the diode 22, which allows only the passage of the positive half cycles of the AC supply, and which is mounted on the blanket, the outer element 24 diode 26, silicone controlled rectifier 28 which controls the power supply as will be described, fuse 30, and the switch 32, which is ganged to switch 16 to operate therewith. Reference numeral 34 indicates a meltdown layer which also has a small NTC.

Conventionally, when a meltdown situation occurs, there is touching of the two conductors, 20, 24, and one of two events takes place, depending upon how near the touching point is to either end of the element. If it is at or nearer the end where the diode 22 is located, than the touching will allow the negative half cycles of the mains supply to pass through the element, via the circuit comprising the switch 32, fuse 30, the parallel resistor pair 36, 38, the parallel diode pair 40, 42, the outer conductor 24, the touching point of the conductors, the inner conductors 20, the fuse 18 and the switch 16. This current heats up the resistors 36, 38 which in turn, being in thermal contact with the fuse 30, melt is causing the power supply to be terminated. In such circumstances, the element is destroyed, as is the blanket.

If the meltdown and conductor contact occurs at the other end (the feed end) of the element, then quite simply the element is more or less short circuited, and fuse 18 fails terminating power supply to the element, but again at the expense of destroying the blanket.

In the instant embodiment however, the rectifier 28 with the aid of an electronic control circuit, controls the power supply so that in the normal mode of operation, meltdown does not occur when there is overheating. The control circuit in question is indicated by the wiring 50, 52, 54, 56.

The power to drive this circuit is derived from the mains so as to generate in this example, 8.2 v DC, using the simple circuit of diode 58, resistance 60, Zener diode 62, diode 64, and capacitor 66.

The control circuit includes a 4093B Quad Nand Gate 68 which with its associated components (68A, 68B) forms a variable mark/space ratio pulse generator whose "on" and "off" times are synchronised via resistors 70, 72 and 74, 76 to the zero point crossing of the mains waveform. Power level six, see diagram, gives an "on" time of 95% of the cycle and power level one gives an "on" time of 5% of the cycle. The total cycle time may be in the order of 5 secs. Such a circuit requires no bulky and expensive radio frequency interference suppression components, and constitutes in its own right an independent aspect of the present invention.

An explanation of the operation of the embodiment of the invention will now be described.

During normal operation, that is to say when no overheating condition exists, the voltage at the junction of the diodes 40, 42 (point "A") is always positive with respect to the ground line 78 (at zero volts) and diode 80 blocks the positive voltage from the control circuit.

Should the blanket, or any part of it, start to overheat, this will be detected by the NTC of the layer 24 whose resistance will change by decreasing slightly, which has the effect of allowing a small leakage current to flow between the conductors 20, 24, which by passes the half wave rectifying diode 22 on the negative half cycles, and a negative half wave current flows. The negative half wave current is averaged to a negative DC current and a safe voltage, in this case 8.2 volts, by means of current limiting resistor 82, the capacitor 84 and the Zener diode 86. This voltage exists at point "B" and by the Zener diode 88, the input to the gate of 68A is clamped to zero volts, which in turn disables the gating circuit 68. This has the effect of closing the rectifier 28, and so the power to the element is cut off and meltdown is avoided. The circuit therefore provides the desired effect of avoiding meltdown and therefore destruction of the blanket every time there is an overheating condition. Should it be however that the control circuit fails for any reason, and overheating takes place, then of course the usual meltdown control will be effective, but in such circumstances the blanket will be rendered unusable.

Figure 2:
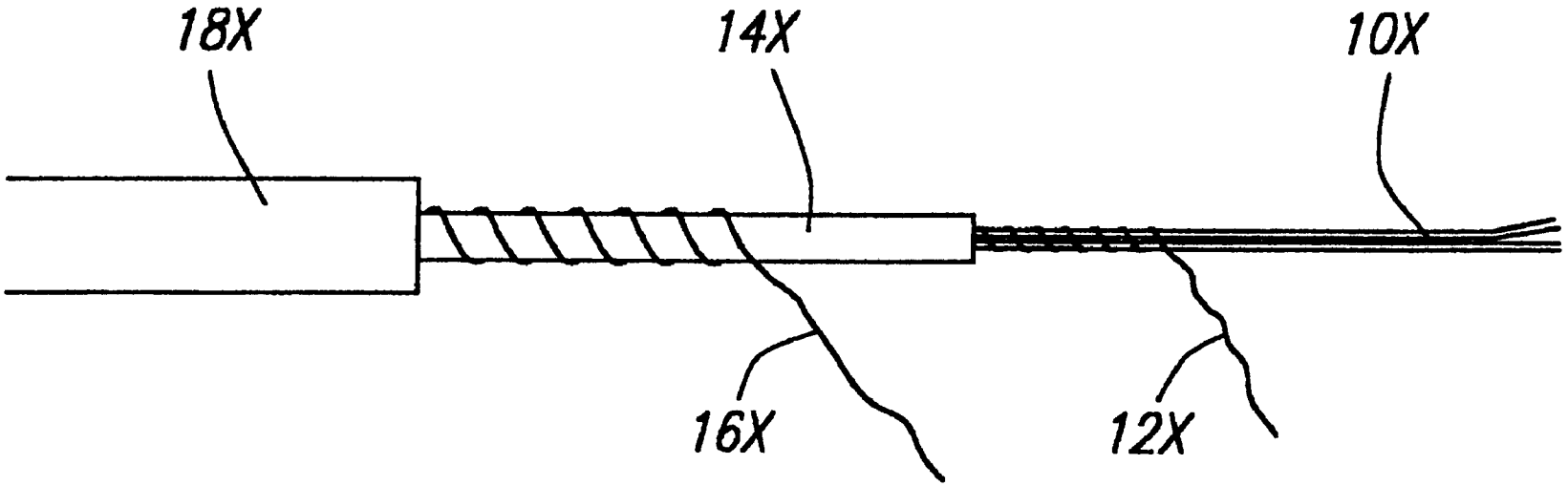
FIG. 2 is a side view of a heating element according to a second embodiment of the invention.
Figure 3:
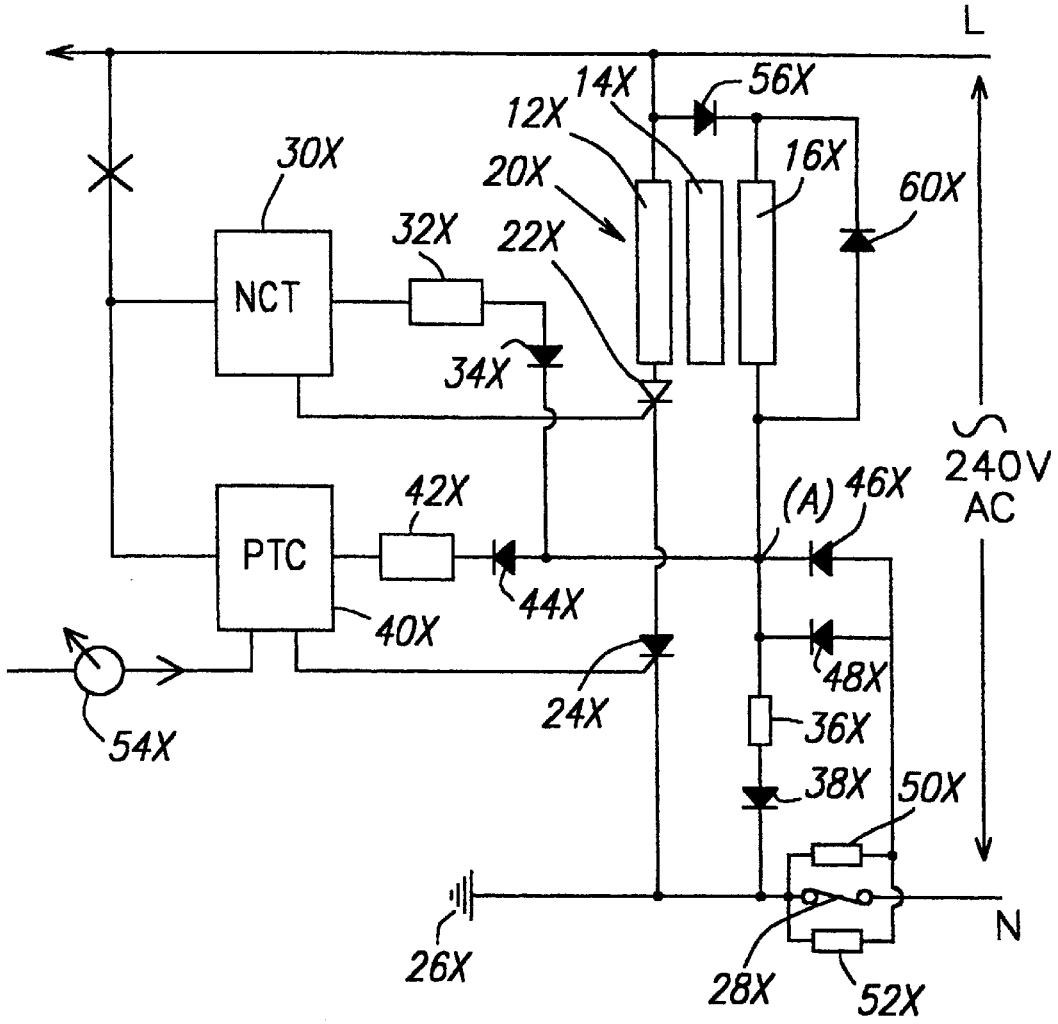
FIG. 3 is a circuit diagram of the heating element as shown in FIG. 2.

FIGS. 2 and 3 show an alternative and more functional embodiment of the invention, and referring to these figures, the heating element shown in FIG. 2 is in the form of a flexible cable and comprises from the centre outwards, a fibre core 10X, a heating element conductor wire 12X which is would helically around the fibre core 10X, a low temperature (120–130° C.) meltdown NTC layer 14X, a PTC conductive sensor wire 16X and an outer layer 18X in the form of a sheath of PVC or the like. The conductor wire 12X is of standard electric blanket type heating wire, and the core is of a type well known to those in the field of flexible heating element manufacture. The layer 14X is preferably an extrusion, and exhibits a small NTC pure nickel. The outer layer 18X is preferably also an extrusion, and is waterproof.

The PTC sensor wire 16 is chosen to have a thickness and is applied in predetermined turns per inch such that for each size of appliance, (with a pre-determined element length), the sensor resistance is always the same value. This means that a common control unit requiring no calibration can be used for each szie of appliance, which is advantageous for manufacturers.

Referring to FIG. 3 which shows a circuit of the heating element shown in FIG. 3, the element components of FIG. 2 being indicated at 20X. The single heating wire 12X is connected in series with two thyristors 22X and 24X across the AC power supply of 240 volts, indicated by live and neutral lines L and N, the N line being connected to earth as shown at 26X. The thyristors 22X and 24X prevent the negative half cycles of the power from passing through the wire 12X. The neutral line N contains a thermal fuse 28X.

The thyristor 2X is connected via its gate to an NTC control unit 30, that unit being in a series circuit across the live and neutral lines L and N, comprising the unit 30, resistor 32X, diode 34X, resistor 36X, and diode 38X.

The thyristor 24X has its gate connected to a PTC unit 40X and that unit 40X is connected in the series circuit between the live and neutral lines L and N, comprising the unit 40X, resistor 42X, diode 44X, diode pair 46X, 48X connected in parallel for security, and parallel resistor pair 50X, 52X. The PTC unit is connected to a temperature control meter 54X, whereby a user can set a mean temperature at which the element will run.

The PTC sensor wire 16X is connected between the lines L and N by being in the series circuit comprising the diode 56X, the sensor wire 16X, the resistor 36X, and the diode 38X.

Finally, a protective diode 60X is connected in parallel across the sensor wire 16X.

The interconnections between the circuits is clear from the diagram.

The operation of the above circuit is described below.

Basically, there are three control systems in the circuit shown, comprising a continuous overheat protection system preventing destruction on overheating (similar to that described in relation to FIG. 1), a precision temperature control system, again similar to FIG. 1, which allows the user to fine tune the temperature at which the element runs, and a meltdown system wherein the power is cut off when the meltdown layer 14X fails. The advantage of this invention this embodiment is that the sensor wire 12X plays a part in all of these controls.

Basically, the continuous non destructive over heat protection system is controlled by the NTC unit 30X. The precision temperature control which allows the user of the appliance to finely control temperature is governed by the PTC control unit 40X. These controls are arranged to operate independently.

Considering firstly the PTC control system, positive half cycle pas through diode 56X, through PTC sensor wire 16X, through resistor 36X, which is a current sensor resistor, through diode 38X and through the thermal fuse 28X to neutral N. At a temperature of approximately 20° C., the positive voltage at junction (A) will be approximately 4.6 volts. As temperature in the blanket rises, because of the PTC effect of the sensor wire 16X, the resistance of the wire 16X goes higher. This causes the voltage at (A) to fall (approximately 4 volts at 50° C.) This fall in voltage is detected by the PTC unit 40X which has comparator and control logic, and if the user selected temperature setting, say 45° C. is exceeded, thyristor 24X will switch off. The power to heating element 12X is switched of and when the temperature again falls below the set level, the thyristor 24X again switches on and heating resumes.

The control logic 40X, and indeed the NTC logic, are only allowed to switch on and off at a zero crossing point of the mains voltage. This is to ensure RFI (radio frequency interference) free operation. In this way, the temperature of the blanket can be accurately controlled. If this temperature control system fails or a localised hot spot on the blanket which is not detectable by the PTC system occurs, then the NTC system which is fixed on a higher temperature than is normally encountered by the appliance, comes into operation.

The NTC control system works in a parallel manner. That is to say, any localised hot spot at any point along the element can be detected. As can be seen in FIG. 3, the heating element 12X and the PTC sensor 16X are separated along the entire length of the element by the NTC layer 14X. The resistance of this layer 14X, goes down with temperature increase. When this occurs the following takes place:

Negative half cycles from neutral N pass through the thermal fuse 28X, resistors 50X and 52X, which are in thermal contact with the thermal fuse 28X, through the diodes 46X, 48X, the PCT sensor wire 16X, across the fault path through the NTC layer 14X, through the heating element wire 12X and back to live. Diode 56X blocks negative half cycles from what would be a short circuit. Diode 38X prevents the heater resistors 50X, 52X from being short circuited by the sensor resistor 36X. Even a small amount of negative half cycle leakage will cause a negative half cycle voltage to appear at (A). This is detected by the NTC comparator and control logic 30X and if it is over a pre-set amount, logic 30X shuts down the power by shutting off the thyristor 22X. Note that for safety reasons, the PTC and NTC detectors 40X, 30X are completely electronically separate and failure of either will not affect the other.

To satisfy approvals, a thermal melt down system is still utilised. This uses the low melt down characteristics of the NTC layer 14X. This is a standard melt down system and works in that if both the PTC and NTC systems fail, then any hot spot on the flexible heating appliance will eventually cause the NTC layer 14X to melt (120° to 130° C. approximately) when the following occurs Negative half cycles flow from neutral through the thermal fuse 28X through the heater resistors 50X, 52X, through the diodes 46X and 48X, through the sensor wire 16X, either directly or thought the diode 60X, through the melt down area to the heat element 12X, and to the live terminal L. This current causes the heater resistors 50X and 52X to heat up rapidly. This resistors are in thermal contact with the thermal fuse 28X which will rupture at a pre-set temperature, say 102° C., thus cutting off the power from the appliance.

It can be seen from the above that in fact the arrangement of FIGS. 2 and 3 has triple overheat protection. There is no other system which offers such sophistication in such simple configuration. The PTC and NTC comparator and logic control blocks can take many forms. Electronically, many different systems can be used.

Preferably, as between different heating elements at least according to the embodiment of the invention shown in FIGS. 2 and 3, the PTC wire and thickness and turns per unit distance along the heating conductor are chosen so that for each size of element, having a predetermined length, the sensor wire resistance is always the same value, so that a common control unit requiring no calibration can be used for each size of heating element, improving manufacturing procedure.

Any suitable material may be used for the meltdown/NTC layer, but we are proposing at this stage to use doped PVC, which comprises an extrudate of the PVC into which has been mixed 25% of Stannotin Antimony to provide the NTC characteristic, but of course any other suitable material can be adopted.

What is claimed is:

1. An elongated heating element for an electric blanket comprising a first conductor means to provide heat for the blanket and extending lengthwise of the element, a second conductor means extending lengthwise of the element, and a meltdown layer between the first and second conductor means having a meltdown characteristic less than about 130° C., and an NTC, and including electronic control means set to detect a change in the resistance of the meltdown layer to provide a means of changing the power supply to the conductor means providing heat to the blanket to prevent destruction of the meltdown layer.

2. A heating element according to claim 1, wherein the second conductor means is also a heat providing conductor means.

3. A heating element according to claim 2, wherein one or both conductor means comprises or comprise a heating wire or heating wires.

4. A heating element according to claim 1, wherein the second conductor means comprises a detection or sensing conductor which serves to provide a current path in the event that the temperature of the blanket deviates from a pre-set value.

5. A heating element according to claim 4, wherein the sensing conductor has a positive resistance characteristic (PTC), so that when it heats up its resistance increases and this is used by the electronic control to control the power to the heating conductor means.

6. A heating element according to claim 5, wherein the sensing conductor also provides a current path, which is also through the NTC layer, in the event of that layer showing a condition of too high a temperature, requiring the power to the heating conductor means to be switched off.

7. A heating element according to claim 1, wherein the NTC layer has a low meltdown characteristic (typically 120–130° C.).

8. A heating element according to claim 1, wherein the change in resistance when overheating occurs causes a leakage current to pass through the meltdown layer without destroying the meltdown layer, and the control circuit detects this leakage current and switches off the power supply to the conductors.

9. A heating element according to claim 1, wherein the meltdown layer is a meltdown plastic, such as polyvinyl chloride, polythene or cross linked polyethylene.

10. A heating element according to claim 9, wherein the meltdown plastic is coated or mixed with a dope or the like to achieve the required NTC performance.

11. A heating element according to claim 10, wherein the meltdown layer is a PVC doped with Stantonin Antimony.

12. A heating element according to claim 1, minus the electronic control means.

13. An electric blanket including a heating element according to claim 2.

14. An elongated heating element for an electric blanket comprising:

a first conductor element to provide heat for the blanket and extending lengthwise of the heating element;

a second conductor element extending lengthwise of the heating element;

a meltdown layer between the first conductor element and the second conductor element, the meltdown layer having a meltdown characteristic less than about 130° C., a resistance, and an NTC; and an electronic control element adapted to detect a change in the resistance of the meltdown layer and to change a power to the heating element.

15. The heating element of claim 14, wherein the second conductor element comprises a detection conductor which provides a current path when a temperature of the blanket deviates from a pre-set value.

16. The heating element of claim 15, wherein the detection conductor has a PTC, so that when the detection conductor heats up its resistance increases, and the electronic control element uses the PTC of the detection conductor to control the power to the heating element.

17. The heating element of claim 14, in which the heating element comprises less than three conductor elements.

18. An elongated heating element for an electric blanket consisting of:

a first conductor element to provide heat for the blanket and extending lengthwise of the heating element;

a second conductor element extending lengthwise of the heating element;

a meltdown layer between the first conductor element and the second conductor element, the meltdown layer having a meltdown characteristic less than about 130° C., a resistance, and an NTC; and an electronic control element adapted to detect a change in the resistance of the meltdown layer and to change the power supply to the conductor elements providing heat to the blanket.

* * * * *

UNITED STATES PATENT AND TRADEMARK OFFICE

CERTIFICATE OF CORRECTION

PATENT NO. : 6,310,332 B1
DATED : October 30, 2001
INVENTOR(S) : Grahame Gerrard It is certified that error appears in the above-identified patent and that said Letters Patent is hereby corrected as shown below:

Column 2,
Line 17, please change “At” to -- As --.
Line 26, please change “is” first occurrence to -- it --.

Column 5,
Line 1, please change “would” to -- wound --.
Line 8, please change “pure nickel” to -- charateristic --.
Line 8, please add before the word “The” the following sentence -- The sensor wire may be for example pure copper or pure nickel. --

Column 6,
Line 9, please change “of” to -- off --.
Line 32, please change “PCT” to -- PTC --.
Line 59, please change “This” to -- These --.

Signed and Sealed this

Twenty-seventh Day of August, 2002

*Attest:*

*Attesting Officer*

JAMES E. ROGAN
*Director of the United States Patent and Trademark Office*